United States Patent [19]

Schwenke

[11] 3,946,643

[45] Mar. 30, 1976

[54] APPARATUS FOR MANIPULATING SHEET-LIKE BLANKS IN CIGARETTE PACKING MACHINES OR THE LIKE

[75] Inventor: Dieter Schwenke, Hamburg, Germany

[73] Assignee: Hauni-Werke Körber & Co. KG, Hamburg, Germany

[22] Filed: June 20, 1974

[21] Appl. No.: 481,354

[30] Foreign Application Priority Data

July 6, 1973 Luxemburg ..... 67958

[52] U.S. Cl. ..... 93/12 C; 93/44.1 R

[51] Int. Cl.[2] ..... B31B 1/28

[58] Field of Search..... 93/12 C, 12 R, 39.2, 39.3, 93/44, 44.1 R, 54.3, 77 R, 81 R, 81 MT, 94 PS, 54.1

[56] References Cited

UNITED STATES PATENTS

| | | | |
|---|---|---|---|
| 872,835 | 12/1907 | Maxwell | 93/44.1 R X |
| 1,525,612 | 2/1925 | Jones | 93/44.1 R X |
| 1,875,986 | 9/1932 | Bronander | 93/44.1 R |
| 2,237,828 | 4/1941 | Hatch et al. | 93/39.2 X |
| 2,931,276 | 4/1960 | Zerlin | 93/44.1 R X |
| 3,124,046 | 3/1964 | Jungmayr | 93/12 R |
| 3,435,735 | 4/1969 | Whitaker | 93/44.1 R X |
| 3,589,097 | 6/1971 | Gianese | 93/44 X |

*Primary Examiner*—James F. Coan

*Attorney, Agent, or Firm*—Kane, Dalsimer, Kane, Sullivan and Kurucz

[57] ABSTRACT

A cigarette packing machine wherein a turret with equidistant prismatic mandrels is indexible stepwise so as to locate successive mandrels at a draping station during each period of idleness between successive stepwise advances. A sheet-like blank is draped around the mandrel at the draping station by a cylindrical brush which is eccentrically mounted on a disk rotating with a shaft which orbits about a fixed axis parallel to the axis of the turret. The shaft is rotated about its own axis by a gear train while it orbits about the fixed axis whereby the brush travels about the mandrel at the draping station to convert the blank into an open-ended tube which is thereupon converted into one layer of a cigarette pack.

15 Claims, 2 Drawing Figures

APPARATUS FOR MANIPULATING SHEET-LIKE BLANKS IN CIGARETTE PACKING MACHINES OR THE LIKE

BACKGROUND OF THE DISCLOSURE

The present invention relates to apparatus for manipulating deformable sheet-like blanks which consist of paper, metallic foil, plastic foil or other suitable wrapping material. More particularly, the invention relates to improvements in apparatus for converting sheet-like blanks into tubular envelopes by draping the blanks around patterns whose configuration corresponds to that of packs for cigarettes, cigars, cigarillos or other rod-like smokers' products.

A packing machine for groups of cigarettes or the like normally comprises at least one turret which is driven continuously and carries a number of equidistant prismatic mandrels which advance first along a blank-applying station and thereupon past several blank-folding or draping stations where the blanks are converted into tubular envelopes each of which surrounds four sides of the respective mandrel. Each tubular envelope is thereupon closed at one end so that a group of cigarettes can be introduced into its interior through the other end which remains open. The other end of each envelope is thereupon closed, for example, by a revenue label. If the packs consist of several layers, each mandrel receives several blanks each of which is converted into a layer of the finished pack. Reference may be had to the commonly owned U.S. Pat. No. 3,750,676 granted Aug. 7, 1973 to Kruse et al.; this patent discloses a machine for the making of ciagarette packs each of which consists of an inner layer of metallic foil and an outer layer of paper or cardboard.

When the turret which carries the mandrels is driven uninterruptedly, i.e., without periods of dwell, the draping of blanks around the mandrels is performed by a host of instrumentalities including at least one folding member for each mandrel. Such folding members travel with the respective mandrels along a circular path and are caused to perform predetermined movements with respect to the associated mandrels to thereby carry out certain folding operations upon the blanks. As a rule, the folding members are caused to move relative to the mandrels by stationary cams or ways which are adjacent to the path of movement of the mandrels. The machine further comprises means for pressing the blanks against the respective mandrels so as to prevent undesirable shifting of blanks during conversion into tubular envelopes and thereupon into finished layers of cigarette packs.

A drawback of the just described packing machines is that the mechanism for converting blanks into tubular envelopes is complex, expensive and prone to malfunction. This is attributable to a large extent to the fact that such mechanism must include at least one discrete folding member for each mandrel. Repeated impacting of mobile folding members against cams or ways results in pronounced wear and creates considerable noise. Moreover, the means for pressing the blanks against the adjacent mandrels is likely to permit at least some shifting of blanks, especially if the turret is rotated at a high speed which is desirable in modern packing machines. Improper folding of a single blank or of a short series of blanks necessitates a lengthy interruption in the operation of the packing machine with attendant losses in output, especially if the packing machine forms part of a production line which further includes one or more cigarette rod making machines and one or more filter cigarette making machines.

SUMMARY OF THE INVENTION

An object of the invention is to provide a novel and improved apparatus which can be used in packing machines for cigarettes or the like to convert deformable sheet-like blanks into preferably tubular envelopes preparatory to conversion of such envelopes into inner, outer or intermediate layers of packs for rod-shaped smokers' products.

Another object of the invention is to provide the apparatus with novel and improved means, including a single draping or folding device, which can convert blanks into tubular envelopes on successive mandrels of an indexible (intermittently driven) turret or analogous support for a plurality of discrete mandrels.

A further objct of the invention is to provide the apparatus with novel and improved means for moving the single draping or folding device with respect to the adjacent mandrel.

An additional object of the invention is to provide an apparatus which can convert blanks into tubular envelopes in a cigarette packing machine or the like and which is simpler, more reliable, more rugged and less expensive than heretofore known apparatus.

Still another object of the invention is to provide a novel and improved draping or folding device for use in the above outlined apparatus.

The invention is embodied in an apparatus for converting deformable sheet-like blanks into tubular envelopes, particularly for converting blanks consisting of paper, cardboard, metallic foil or the like into tubular portions of packs for cigarettes or other rod-shaped smokers' products. The apparatus comprises a turret or an analogous support which is indexible about a predetermined axis so that periods of idleness of the support alternate with intervals of angular movement through predetermined distances, a plurality of preferably hollow prismatic mandrels fixedly mounted on and indexible with the support so that successive mandrels occupy a draping or folding station during successive periods of idleness of the support, a blank folding member at the draping station, and means for moving the folding member about a mandrel at the draping station during each period of idleness of the support so that the folding member converts a sheet-like blank which is disposed between the folding member and the mandrel at the draping station into a tubular envelope which surrounds four sides of the respective mandrel.

The folding member may constitute a cylindrical brush and the moving means preferably defines for the folding member an endless path and includes a mechanism for moving the folding member along the endless path during each period of idleness of the support.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
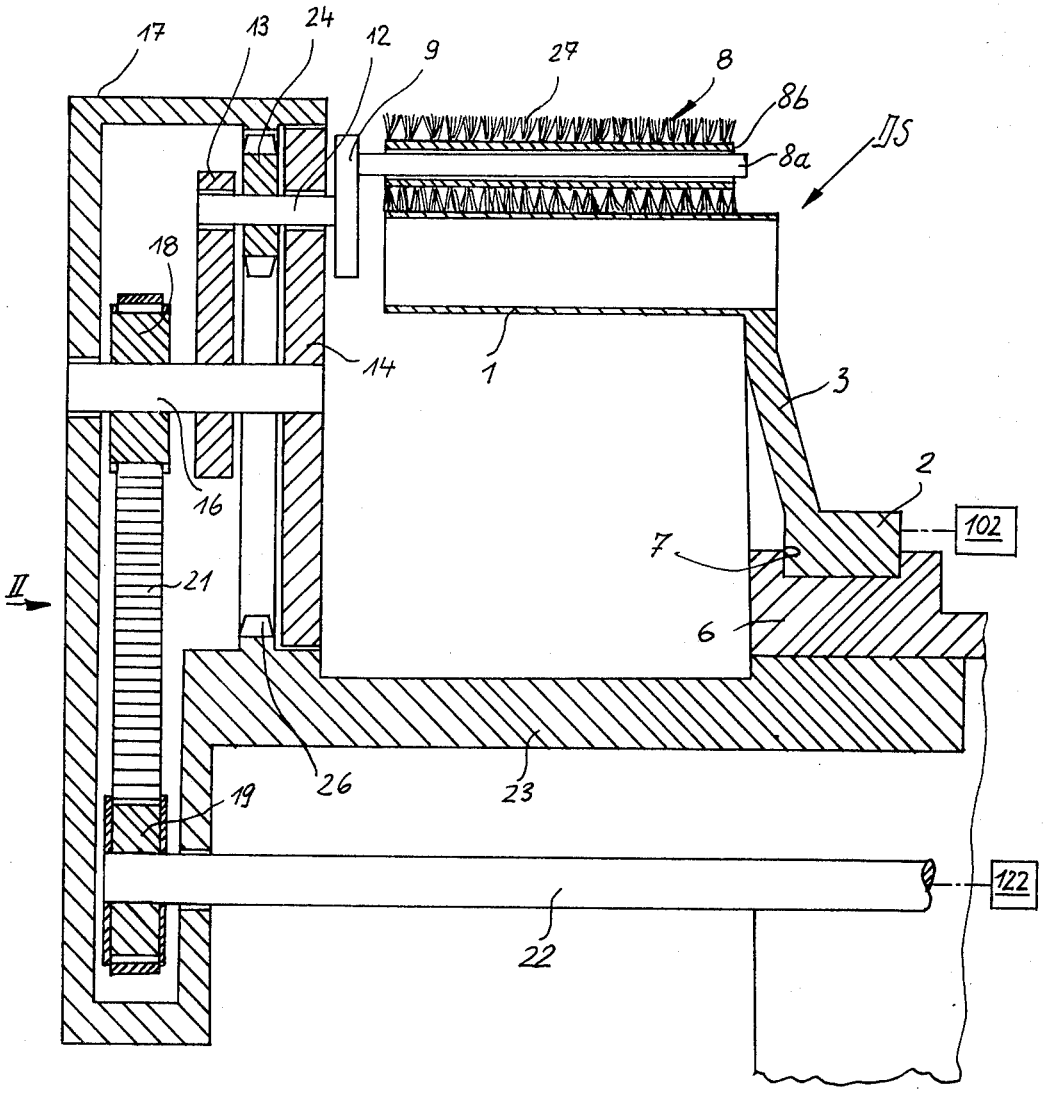
FIG. 1 is a fragmentary longitudinal sectional view of an apparatus which embodies the invention.
Figure 2:
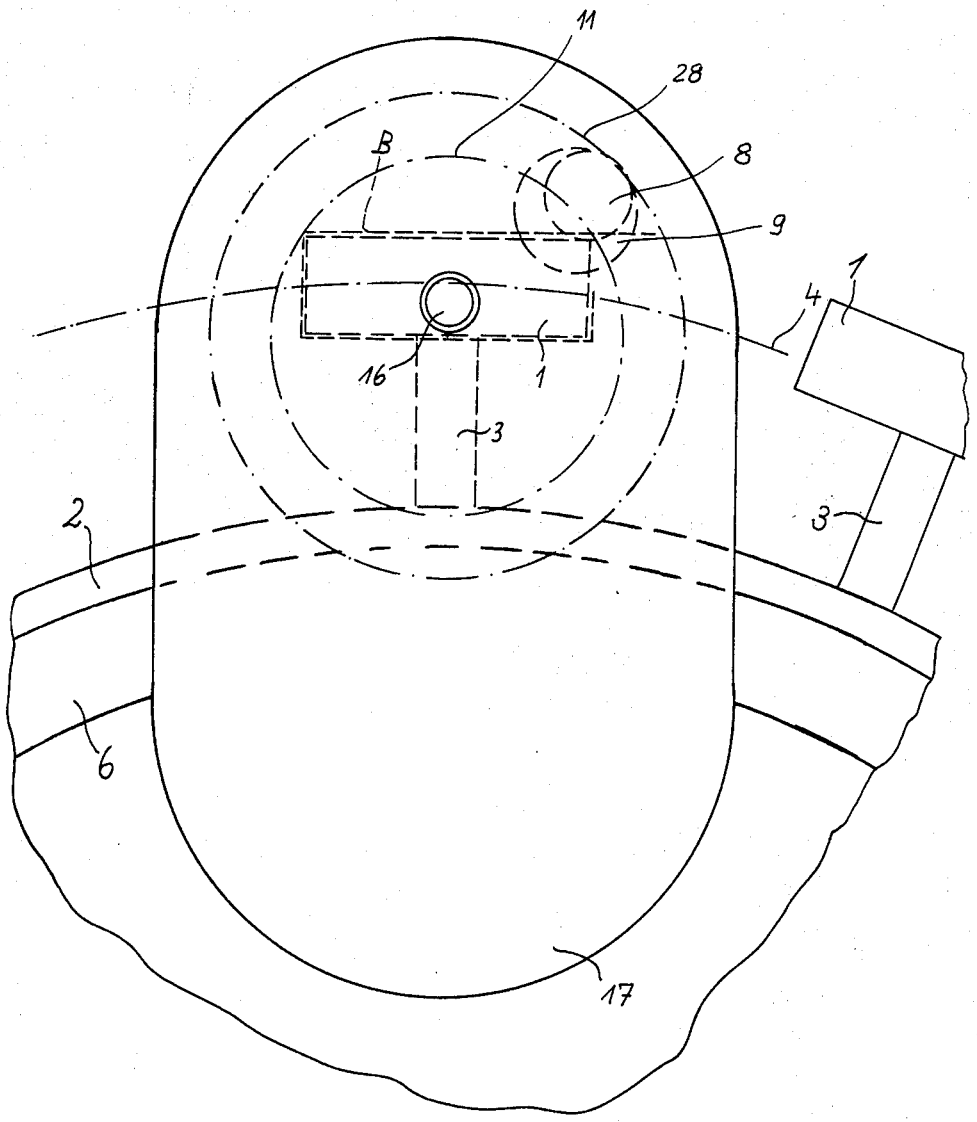
FIG. 2 is a fragmentary schematic end elevational view as seen in the direction of arrow II in FIG. 1.

The apparatus of FIGS. 1 and 2 comprises an indexible turret 2 which constitutes a support for an annulus of equally spaced mandrels 1 (two shown in FIG. 2). Each mandrel 1 is a hollow body having a polygonal cross-sectional outline (see FIG. 2) resembling that of a cigarette pack. The mandrels 1 are fixedly secured to discrete spokes or arms 3 which are integral with the hub of the turret 2. The hub of the turret is rotatable in a circumferentially complete external groove 7 of a stationary bearing member 6. The means for indexing the turret 2 in such a way that each period of idleness or dwell is followed by an interval of angular movement through a predetermined distance is shown schematically at 102; such indexing means may comprise a geneva movement or any other mechanism which can index the mandrels 1 at regular intervals so that a mandrel invariably occupies a draping station DS when the turret 2 is at a standstill.

A mandrel 1 which occupies the station DS serves as a core or pattern for the deformation of a sheet-like blank B (e.g., a rectangular sheet of paper, metallic foil or thin cardboard) which is to be converted into a tubular envelope by being draped around four sides of the respective mandrel. When a mandrel 1, with a tubular envelope therearound, is advanced by one or more steps to a further station or to a series of successive stations, one end of the tubular envelope is closed but the other end remains open so that a group of for example 20 properly arrayed cigarettes (not shown) can be introduced into the mandrel and thereupon through and beyond the mandrel whereby the envelope is stripped off the mandrel and is transferred into a mandrel on a second turret for further treatment which may include closing the open end of the envelope and applying a revenue label in a manner not forming part of the present invention.

The means for supplying blanks B to successive mandrels 1 at the draping station DS is not shown; such feeding means may be constructed and operated in a manner as disclosed in the aforementioned commonly owned U.S. Pat. No. 3,750,676 to Kruse et al. A mandrel 1 can receive a blank B before it reaches the station DS.

In accordance with a feature of the invention, successive blanks B are converted into tubular envelopes by a single folding or draping member 8 here shown as a cylindrical brush having tufts of substantially radially extending pliable bristles 27. The means for moving the brush 8 around a mandrel 1 at the draping station DS (while the turret 2 is at a standstill) comprises a mechanism which causes the brush to travel along an endless path extending around the mandrel so that the blank B is draped around all four sides of the mandrel and two of its parallel marginal portions overlap each other in a manner well known from the art of cigarette packing machines.

The aforementioned mechanism comprises a disk-shaped holder 9 which is rigid with a shaft 12 and eccentrically supports the shaft 8*a* of the cylindrical brush 8. The core 8*b* of the brush carries the bristles 27 and may but need not rotate on the shaft 8*a*. The axis of the shaft 8*a* is parallel to the axis of the shaft 12, and the axis of the shaft 12 is parallel to the axis of the turret 2. The shaft 12 orbits about a driven shaft 16 which is parallel thereto and is rotatably journalled in a fixed housing or casing 17 having a horizontal arm 23 which supports the bearing member 6 for the turret 2. The means for rotating the shaft 16 relative to the housing 17 comprises a belt transmission including a first toothed pulley 18 on the shaft 16, a second toothed pulley 19 on a drive shaft 22, and a toothed belt 21 which is trained over the pulleys 18 and 19. It will be noted that the entire belt transmission is encapsulated in the housing 17. The means for rotating the shaft 22 includes a motor or transmission 122 which is set in operation when a mandrel 1 reaches the draping station DS and the turret 2 comes to a standstill.

The means for mounting the shaft 12 for orbital movement about the axis of the driven shaft 16 comprises two parallel carriers 13, 14 which are rigid with the shaft 16 and rotatably support the shaft 12. The shaft 12 is caused to rotate about its own axis while it orbits about the axis of the shaft 16. The means for rotating the shaft 12 comprises a gear train including an internal gear 26 which is fixedly mounted in the housing 17 and is coaxial with the driven shaft 16, and a pinion 24 which meshes with the gear 26 and is rigid with the shaft 12. The pitch circle of the internal gear 26 is shown in FIG. 2, as at 28. The phantom-line circle 11 denotes in FIG. 2 the path of orbital movement of the axis of the shaft 12 about the driven shaft 16. When the shaft 16 is rotated by the belt transmission 18, 19, 21 and the gear train 24, 26 rotates the orbiting shaft 12, the holder 9 causes the brush 8 to perform a complex movement along an endless path which extends around the mandrel 1 at the draping station DS whereby the bristles 27 cause a flat or substantially flat blank B to assume the shape of a tube which surrounds four sides of the mandrel. If desired, the bristles 27 can be replaced with a layer of sponge rubber or other readily deformable elastomeric material which can properly drape a blank while the shaft 8*a* travels about a mandrel 1 at the station DS.

The operation:

The means 102 indexes the turret 2 stepwise so that the turret locates successive mandrels 1 at the draping station DS whenever it ceases to turn about the bearing member 6. The transmission 122 then begins to rotate the drive shaft 22 which rotates the shaft 16 by way of the belt transmission 18, 19, 21 so that the shaft 16 causes the shaft 12 to orbit about the axis of the pulley 18. At the same time, the pinion 24 rolls along the internal gear 26 and causes the shaft 12 to rotate about its own axis so that the holder 9 causes the shaft 8*a* to orbit about the axis of the shaft 12 while the brush 8 participates in orbital movement of the shaft 12 about the shaft 16. The transmission 122 arrests the drive shaft 22 when the brush 8 returns to a starting position whereupon the means 102 indexes the turret 2 in order to advance the next mandrel 1 to the draping station DS. The eccentricity of the shaft 8*a* relative to the shaft 12 and the distance between the axes of the shafts 12, 16 can be readily selected in such a way that the bristles 27 remain in engagement with and fold the blank B in an accurately reproducible manner while the axis of the shaft 12 orbits along the circular path 11. This is desirable in order to insure that the deformed blank closely conforms to the outline of the mandrel 1 at the draping station. It has been found that the bristles 27 on the orbiting brush 8 are capable of converting a flat sheet-like blank B into a tubular envelope without any folds and in such a way that the deformed blank closely follows the outline of the entire mandrel 1, i.e., also the outlines of the four corner portions of the mandrel.

The operation of the means 102 is synchronized with the operation of transmission 122 in such a way that the brush 8 begins to orbit as soon as a mandrel 1 reaches the station DS so that the conversion of blanks B into tubular envelopes can be completed within short intervals of time to thus insure that the packing machine which embodies the apparatus of FIGS. 1 and 2 can turn out a large number of packs per unit of time in spite of the fact that the turret 2 is indexed stepwise. A portion of the path 4 along which the centers of the mandrels 1 move in response to indexing of the turret 2 is shown in FIG. 2 by a phantom line.

The carrier 14 may constitute a disk which is coaxial with the driven shaft 16. In FIG. 1, the other carrier 13 is assumed to constitute a relatively small disk which is eccentrically mounted on the shaft 16. However, it is also possible to employ carrier means in the form of two identical disks which are coaxial with the shaft 16. The carrier 14 can rotate in an antifriction bearing (not shown) provided therefor in the housing 17. This carrier then constitutes a bearing member for the driven shaft 16.

It is further within the purview of the invention to replace the belt transmission 18, 19, 21 with a chain transmission or with a train of gears which rotate the shaft 16 in response to rotation of the drive shaft 22.

The improved apparatus is simpler, more compact and less expensive than heretofore known apparatus for converting sheet-like blanks into tubular envelopes on hollow mandrels or analogous patterns. Moreover, and since the folding member 8 need not share the movements of the turret 2, the means for moving this folding member about a mandrel at the station DS can be fixedly mounted in the frame of a packing machine. The moving parts of the improved apparatus are preferably mounted for rotary and/or orbital movement which causes less wear than oscillatory or other non-circular or non-orbital movements. Moreover, the likelihood of malfunctioning when the folding member 8 is replaced with a fresh folding member is much less pronounced than in heretofore known apparatus wherein at least one discrete folding member must be provided for each mandrel and wherein such discrete folding members must share the movements of the turret.

Another advantage of the improved apparatus is that the flexible bristles 27 subject a blank B to a folding or deforming action which is at least substantially uniform during each phase of conversion of a blank into a tubular envelope. This reduces the likelihood of shifting the blanks during conversion into tubes and insures the formation of a succession of identical or practically identical envelopes, even if the periods of idleness of the turret between successive intervals of angular movement on the bearing member 6 are extremely short.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

1. In an apparatus for converting deformable sheet-like blanks into tubular envelopes, particularly for converting blanks into tubular portions of packs for cigarettes or the like, a combination comprising a support indexible about a predetermined axis so that periods of idleness of said support alternate with intervals of angular movement through predetermined distances; a plurality of mandrels fixedly mounted on and indexible with said support so that successive mandrels occupy a draping station during successive periods of idleness of said support; a blank folding member at said draping station; and means for moving said folding member about a mandrel at said station during each of said periods so that said folding member converts a sheet-like blank which is disposed between said folding member and the mandrel at said station into a tubular envelope which surrounds the respective mandrel.

2. A combination as defined in claim 1, wherein said folding member is a cylindrical body.

3. A combination as defined in claim 1, wherein said support is a turret.

4. A combination as defined in claim 1, wherein each of said mandrels has a polygonal contour.

5. A combination as defined in claim 1, wherein said folding member is a cylindrical brush.

6. A combination as defined in claim 1, wherein the axis of said brush is parallel to said predetermined axis.

7. In an apparatus for converting deformable sheet-like blanks into tubular envelopes, particularly for converting blanks into tubular portions of packs for cigarettes or the like, a combination comprising a support indexible about a predetermined axis so that periods of idleness of said support alternate with intervals of angular movement through predetermined distances; a plurality of mandrels mounted on and indexible with said support so that successive mandrels occupy a draping station during successive periods of idleness of said support; a blank folding member at said draping station; and means for moving said folding member about a mandrel at said station during each of said periods so that said folding member converts a sheet-like blank which is disposed between said folding member and the mandrel at said station into a tubular envelope which surrounds the respective mandrel, said moving means defining for said folding member an endless path and including a mechanism for moving said folding member along said endless path during each period of idleness of said support.

8. A combination as defined in claim 7, wherein said mechanism comprises a shaft, means for orbiting said shaft about a second axis, means for rotating said shaft during orbiting about said second axis, and a holder affixed to and rotatable with said shaft, said folding member being eccentrically secured to said holder so as to orbit about the axis of said shaft while the latter orbits about said second axis.

9. A combination as defined in claim 8, wherein the axis of said shaft is parallel to said predetermined axis and to said second axis.

10. A combination as defined in claim 8, wherein said means for orbiting said shaft comprises a driven second shaft defining said second axis and carrier means fixed to said second shaft and rotatably supporting said first mentioned shaft so that the axis of said first mentioned shaft is parallel to said second axis.

11. A combination as defined in claim 7, further comprising a stationary housing, said means for orbiting said shaft comprising a belt transmission in said housing.

12. A combination as defined in claim 10, wherein said carrier means comprises a plurality of discrete carriers rotatably mounting said first mentioned shaft.

13. A combination as defined in claim 8, wherein said means for rotating said shaft comprises a gear train.

14. A combination as defined in claim 13, wherein said gear train comprises a stationary internal gear and a pinion fixed to said shaft and mating with said internal gear.

15. A combination as defined in claim 14, further comprising a stationary housing for said orbiting means, said internal gear being mounted in said housing and having an axis coinciding with said second axis.

* * * * *